United States Patent [19]

Keady et al.

[11] Patent Number: 4,656,817

[45] Date of Patent: Apr. 14, 1987

[54] APPARATUS FOR LOADING SINGULATED LEAD FRAMES INTO CONTAINERS

[75] Inventors: William M. Keady, Redwood City; Frank Iseger, Campbell; Barry Maidment, Santa Clara, all of Calif.

[73] Assignee: Advalloy, Inc., Palo Alto, Calif.

[21] Appl. No.: 817,586

[22] Filed: Jan. 10, 1986

[51] Int. Cl.[4] ..... B65B 63/00

[52] U.S. Cl. ..... 53/520; 53/529; 53/250; 83/91; 83/167

[58] Field of Search ..... 53/249, 250, 513, 529, 53/520; 83/167, 91, 90, 95

[56] References Cited

U.S. PATENT DOCUMENTS

| | | | |
|---|---|---|---|
| 3,125,134 | 3/1964 | Johnson | 53/250 X |
| 3,263,882 | 8/1966 | Nugent et al. | 83/95 X |
| 3,935,770 | 2/1976 | Bareis et al. | 83/95 |
| 4,216,689 | 8/1980 | Suhling | 83/91 X |

*Primary Examiner*—James F. Coan

*Attorney, Agent, or Firm*—Owen, Wickersham & Erickson

[57] ABSTRACT

A rotating, indexable carousel-like apparatus for retaining lead frame containers for use in combination with a singulation press which severs a reel of lead frames and progressively loads the lead frames into the containers. The carousel-like apparatus can accommodate multiple lead frame containers and comprises a baseplate, circular container holder, lead frame guide means and indexing means. Also, there are means to ensure container retention within the apparatus. The apparatus includes means which raise the baseplate and container holder to a loading position and lower them to an indexing position. The apparatus will automatically index to the next loading position when a container is fully loaded. The apparatus includes means which monitor both carousel position and lead frame position and will inhibit press operation if either the apparatus, lead frames or containers within the apparatus are misaligned.

15 Claims, 6 Drawing Figures

52
54

26
34
18
17
36
20
10
36
32
46
24
22
14
52
5
5
44
48
50

APPARATUS FOR LOADING SINGULATED LEAD FRAMES INTO CONTAINERS

This invention relates to an apparatus for loading containers, and more particularly to an apparatus for loading semiconductor lead frames from a singulation press into containers for storage or shipment.

BACKGROUND OF THE INVENTION

Metal lead frames are used to provide a supporting interconnection between a semiconductor device and circuitry which utilizes the device. Heretofore such lead frames were stamped in the desired configuration from a long metal strip and the frames remained connected together. The strip of lead frames was coiled into a roll for shipment to a semiconductor manufacturer where single frames were cut therefrom. The handling and shipping of lead frames in roll form presented problems of excessive shipping space, damage from handling and the need for the semiconductor manufacturer to provide a precision means for cutting single lead frames from the roll. These problems were solved through the use of a carrier device or container for protecting and holding a stack of identical, separate lead frames for shipment and storage. However, inherent in the use of such containers was the problem of efficient cutting and loadig of single frames into the containers. Although the lead frames can be severed from a reel and progressively loaded by a singulation press, heretofore it was necessary for each container to be manually placed in and removed from the press. Also there was a problem of controlling the lead frames just as they are severed from the reel and transferred into the container. Because of their configuration and light weight, the severed lead frames often became askew and misaligned inside the container, thereby causing the loading process to be halted. These problems have been solved by the present invention which provides a rotating, indexable carousel-like apparatus for retaining and automatically indexing multiple lead frame containers while they are being loaded from a singulation press thereby minimizing the need for human intervention.

Another object of the present invention is to provide a loading apparatus for lead frame containers having guide means which extend upward through the base of the lead frame container to guide the stamped lead frames into the container.

Another object of the present invention is to provide a rotating, indexable carousel-like platform for retaining a plurality of lead frame containers which raises itself prior to the loading of a container in order to close the gap between the punch element of the singulation press and the container and thereby eliminate loss of control of the stamped lead frames.

Still another object of the present invention is to provide a carousel-like apparatus for loading single lead frames into containers which has automatic safety checks of both container position and lead frame position to inhibit singulation press loading of lead frames if either apparatus, container or lead frames are misaligned.

Yet another object of the present invention is to provide a lead frame loading apparatus having interchangeable base plate assemblies with different guide pin settings to accommodate containers for lead frames of different configurations.

SUMMARY OF THE INVENTION

In accordance with the principles of the present invention, a semiconductor lead frame singulation (severing) tool and a lead frame loading machine is provided in the form of a rotating, indexable carousel-like device with open-ended compartments to accommodate multiple lead frame containers for loading by the singulation tool. The carousel-like apparatus which sits atop a rotary indexing table. The rotary indexing table is controlled by an air solenoid. The carousel-like device comprises a circular baseplate, lead frame guide pin support plates and a circular container holder with open-ended container compartments. The rotary indexing tabletop has three vertical locator pins equally spaced apart and at an equal distance from the center thereof which hold the table in place. Three air cylinders located between the locator pins on the indexing tabletop, which are connected together by means of a swivel junction to a single independent air solenoid located beneath the base-plate, operate to raise the carousel-like device to a loading position and then lower it to an indexing position. The carousel-like device slides up and down about the vertical locator pins integral to the rotary indexing table. Square lead frame guide pin support plates are affixed to the baseplate corresponding in both area and location to the container compartments of the circular container holder. Integral to the lead frame guide pin support plates are two vertical guide pins, which extend upward through the base of each container within the apparatus to guide the stamped lead frames into the container. Also, interchangeable baseplate assemblies are provided with different guide pin settings to accommodate containers for lead frames of different configurations. The baseplate has slots extending inward from the perimeters thereof, which are located beneath the middle of the guide pin support plates corresponding to the center of each container within the apparatus. Each guide pin support plate has a dowel in the center thereof extending upward which fits into the base of each container within the apparatus. Also, the circular container holder has two dowels on each of its open-ended container compartments which fit into opposite outwardly extending flange portions of each container within the apparatus. Oppositely located on the exterior of the rotary indexing table beneath the baseplate assembly are two safety switches which monitor both apparatus horizontal or rotary position, and vertical position. The rotary safety switch inhibits raising of the apparatus to the loading position unless the container is precisely lined up with the singulation press punch element. Also, the vertical safety switch inhibits indexing to another container position unless the apparatus is in the lowered position. An electronic safety check is provided within the punch element of the singulation press. Continued operation of the press is halted if a lead frame is misaligned with respect to either the punch element or the container within the carousel-like apparatus. The punch element has two recesses in its stamping surface to accommodate the tips of the lead frame guide pins when the press is operating.

Other objects, advantages and features of the invention will become apparent from the following detailed description of one embodiment thereof presented in conjunction with the accompanying drawings.

DETAILED DESCRIPTION OF THE PREFERRED EMBODIMENT

Figure 1:
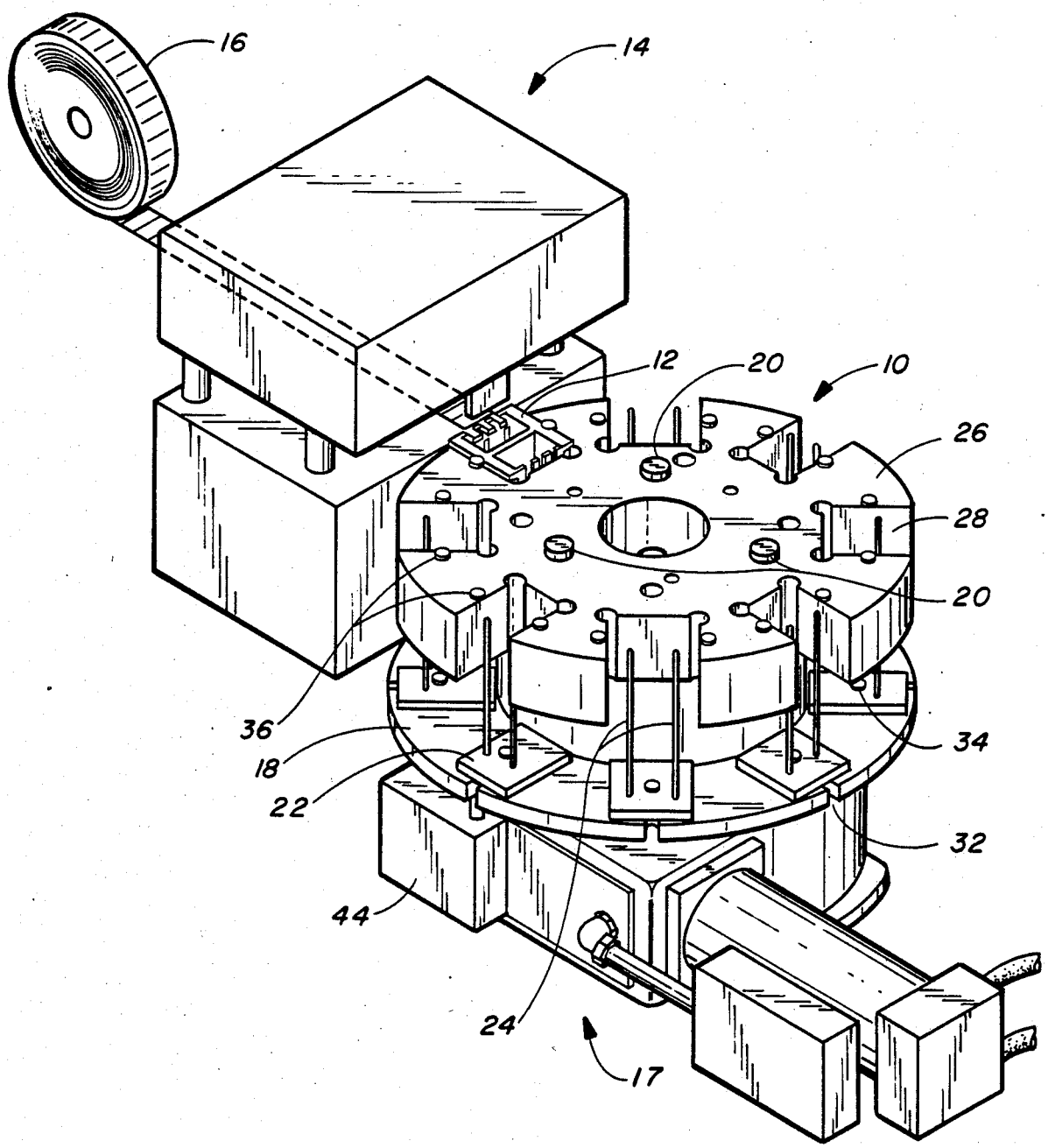
FIG. 1 is a view in perspective of a lead frame loading apparatus according to the present invention showing a carousel-like platform adjacent to a singulation press supporting a roll of lead frames to be severed for loading into a container retained by the apparatus.

With reference to the drawing, FIG. 1 shows a lead frame loading apparatus 10 embodying the principles of the present invention for retaining lead frame containers 12 within a singulation press 14. The singulation press 14 is a commercially available electrically powered stamping machine or punch. The press 14 has an automatic feeding mechanism which enables the continuous loading of each container 12. Also, a digital counter monitors the loading of lead frames and halts the loading process when the desired number of lead frames has been loaded. The lead frames are punched from a thin strip of metal which was stored and heretofore shipped in roll form 16. As well known, such lead frames may have various sizes and configurations to accommodate different semiconductor devices. In accordance with the present invention, the lead frames 16, originally formed in a continuous roll, are cut into individual frames and progressively stacked within a special container 12 for shipment, storage and eventual dispensing at a semiconductor packaging assembly line. A more detailed description of the container 12 used with the loading apparatus 10 is contained in U.S. patent application Ser. No. 06/772,605, filed Sept. 4, 1985.

In FIG. 1, the loading device 10 sits atop a standard rotary indexing table 17. The indexing table 17, has a flat tabletop which serves as a base for the loading device 10. The indexing table 17 is controlled by an air solenoid and rotates in a clockwise direction. The loading device rotates with the indexing table. The loading device 10 is comprised of a circular baseplate 18 which is held in place by three vertical locator pins 20 integral to the indexing table 17. The vertical locator pins 20 are equally spaced apart from each other and at the same distance from the center of the indexing table 17. Square guide pin support plates 22 are fixed to the baseplate which form a base for each container 12 to be held within the apparatus. Two vertical guide pins 24 extend upwards through the base of each container to assure uniform stacking of the lead frames within the container. A circular container holder 26 is also held in place by the three locator pins of the indexing table 17. The container holder 26 has eight square open-ended compartments 28. The square compartments 28 extend inward from the perimeter of the container holder 26 thereby forming a space precisely the same size of the containers to be held within the device 10 as shown in FIGS. 1 and 2.

A digital counter output of the singulation press 14 triggers the indexing of the loading device 10 to the next loading position; when a preselected number has been reached, that equals a fully loaded container, the rotary indexing table 17 automatically indexes the loading device 10. The baseplate 18 has eight slots 32 extending inward from its perimeter corresponding to the center of the open-ended compartments to indicate loading device position adjacent to the singulation machine as shown in FIGS. 1 and 2.

As shown in FIGS. 1–4, each guide pin support plate has a dowel 34 in the center thereof which fits through the base of each container retained within the loading device 10. The circular container holder 26 has two dowels 36 on opposite sides of the container compartments which fit into the outwardly extending flange portions of each container to ensure retention of each container with the loading device.

Figure 2:
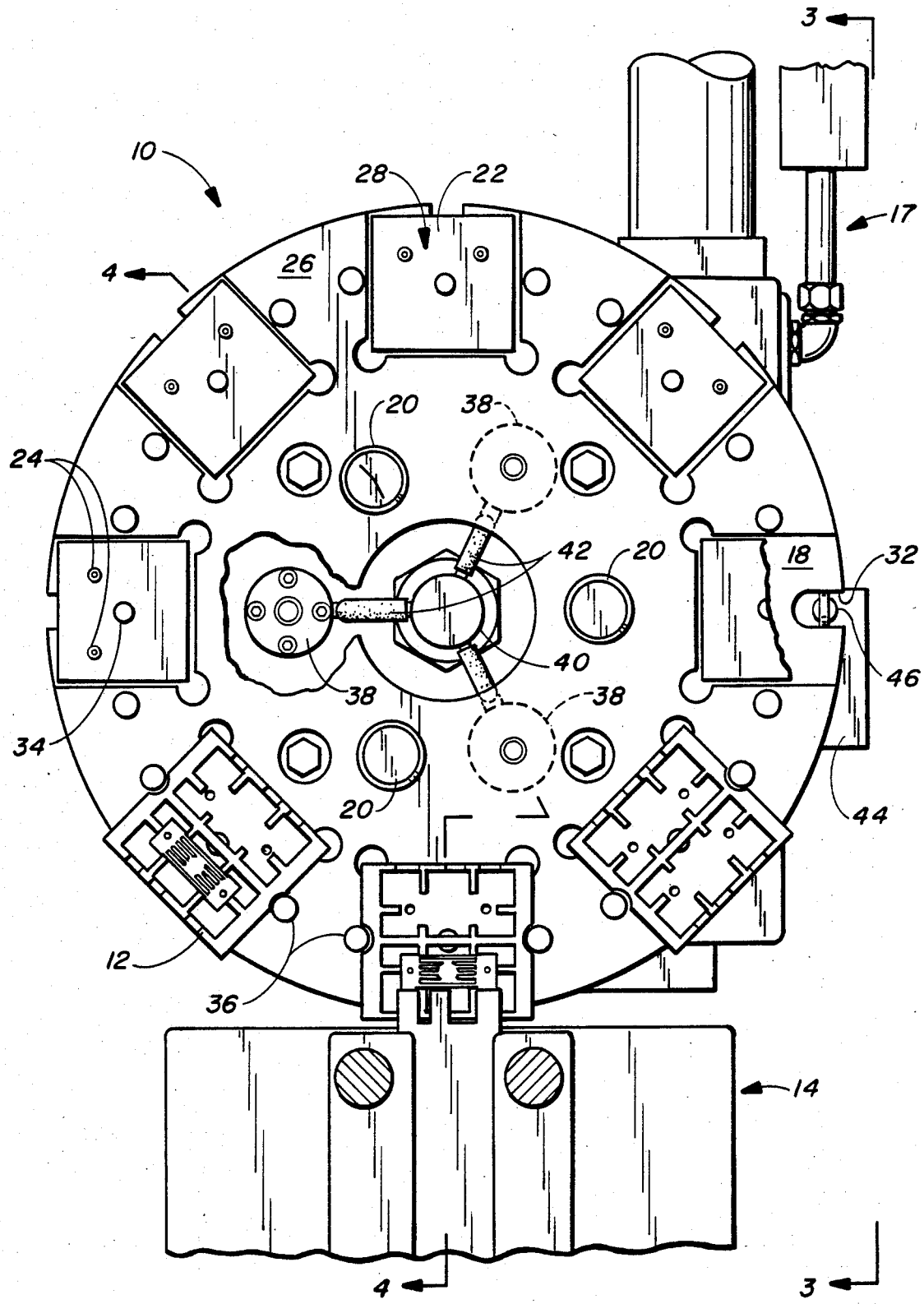
FIG. 2 is a top view of the carousel-like apparatus of FIG. 1 adjacent to the singulation press showing three containers in the apparatus.
Figure 4:
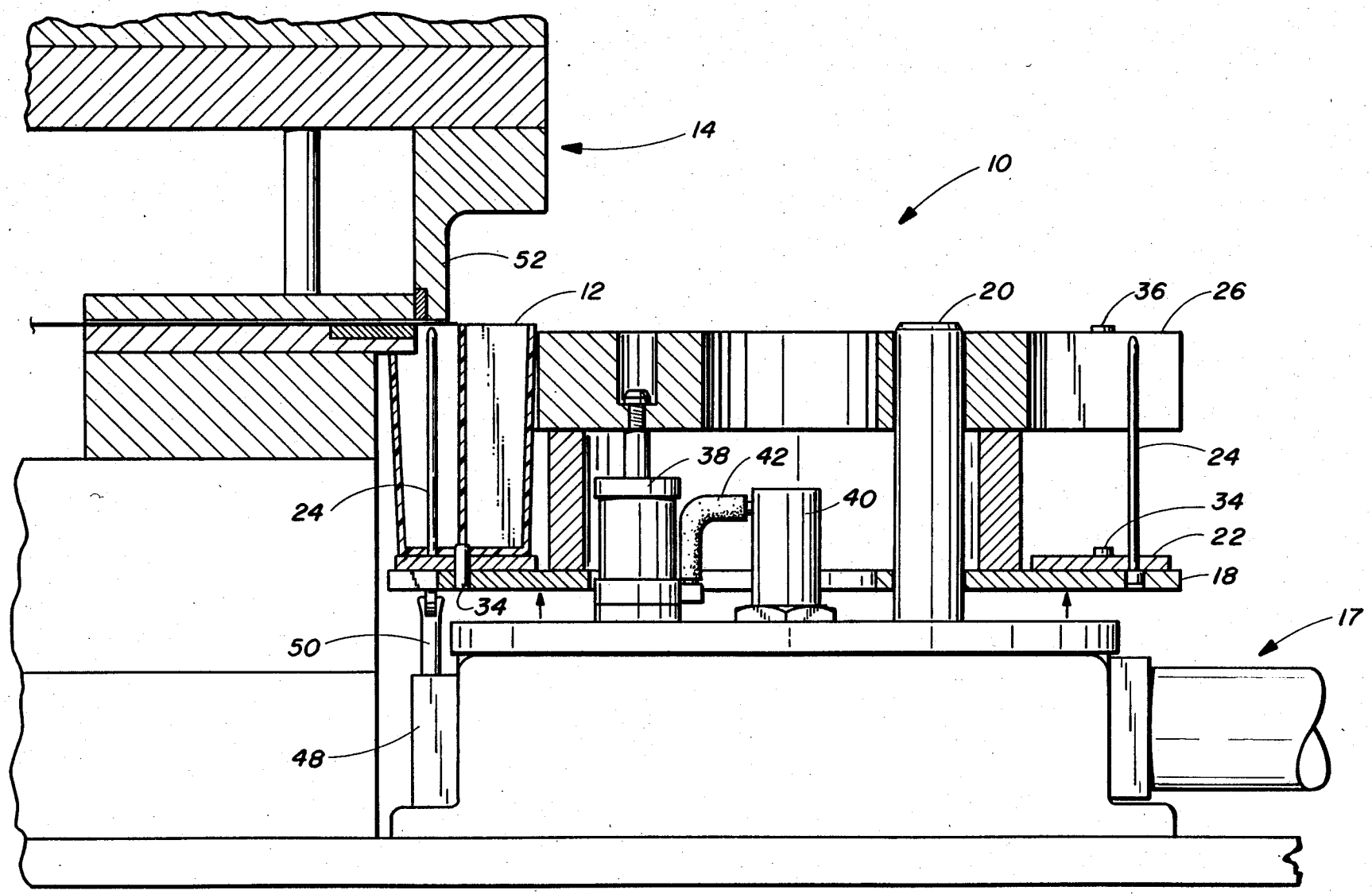
FIG. 4 is a side view of the carousel-like device adjacent to the singulation press taken along the line 4—4 of FIG. 2 showing the device in a raised loading position.

The indexing table 17 has three air cylinders 38 equally spaced between the locator pins 20 as shown in FIG. 2. The air cylinders are connected to a common air solenoid 40 by means of a swivel junction 42 and are operable to raise the baseplate 18 and the circular container holder 26 to a loading position as shown in FIGS. 2 and 4. Both the baseplate 18 and the container holder slide about the vertical locator pins 20 integral to the indexing table 17. The indexing table 17 is not capable of any vertical displacement, it remains vertically stationary.

Figures 3, 5:
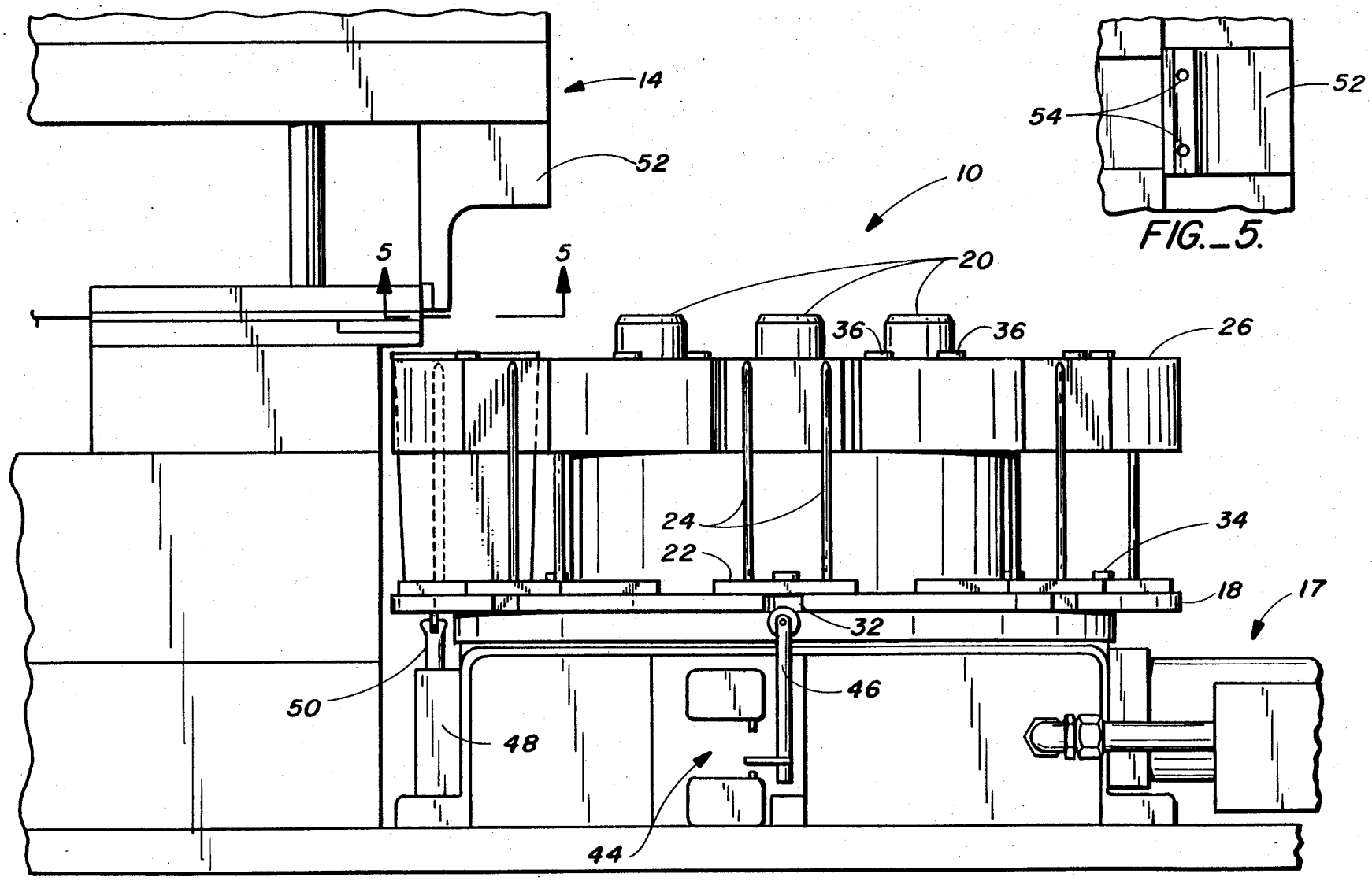
FIG. 3 is a side view of the carousel-like apparatus adjacent to the singulation press taken along the line 3—3 of FIG. 2 showing the apparatus in a lowered indexing position.
FIG. 5 is a fragmentary view in section of the stamping surface of the punch element of the singulation press taken along the line 5—5 of FIG. 3.

Located on the exterior of the rotary indexing table 17 is a safety switch 44 which monitors the x–y axis rotary position of the loading device 10 adjacent to the singulation press 14 as shown in FIG. 3. The switch 44 utilizes a plunger 46 which fits into the baseplate slots 32 to prevent raising the loading device 10 while it is in the process of indexing to the next container position as seen in FIGS. 2 and 3. Also mounted on the exterior of the rotary indexing table 17, opposite the x–y axis safety switch, is another safety switch 48 which monitors the z-axis vertical position of the loading device 10 as shown in FIGS. 3 and 4. This switch 48 also utilizes a plunger 50 which abuts the baseplate 18 when the loading device 10 is in a lowered indexing position. Safety switch 48 prevents indexing to another container while the loading device 10 is in a raised loading position.

The punch element 52 of the singulation machine, as shown in FIG. 5, has two recesses 54 on its stamping surface. The recesses 54 accommodate the ends of the vertical guide pins extending upward through the base of the containers during the loading of lead frame containers within the loading device. The punch element 52 literally enters the container and fits over the guide pins while stamping and loading lead frames.

Figure 6:
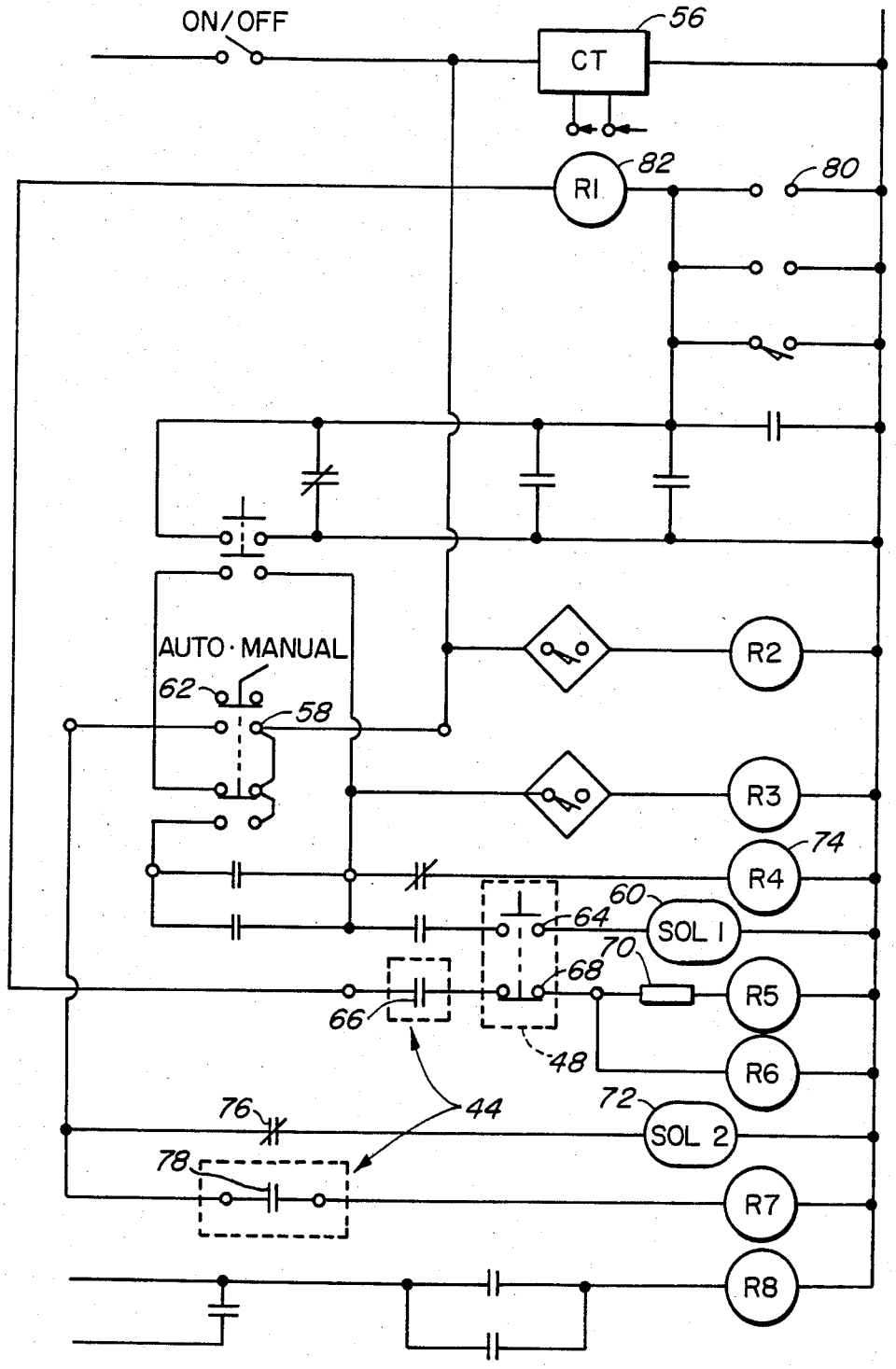
FIG. 6 is a circuit diagram showing singulation press control circuitry, safety switches and air solenoid circuitry for the apparatus of FIG. 1.

FIG. 6 shows the singulation press control circuitry. Only a portion of the press control circuitry affects the operation of lead frame container loading apparatus. The circuitry which affects the loading device is annotated in FIG. 6 and described herein. A predetermined digital counter 56 is provided which controls press operation and triggers the automatic indexing of the loading device to the next container position. This counter 56 energizes the auto-index circuitry 58 which, in turn, energizes the number one air solenoid 60 that controls the indexing of the rotary indexing table; this auto-indexing function has a bypass switch position 62 as shown. The vertical z-axis safety switch 48 will inhibit the energizing of the number one air solenoid 60 to index the loading device if the device is in a raised position and the switch 65 is open as shown. For loading of the containers within the device to take place, the horizontal x–y axis safety switch 44 must be in the upper closed position, with the plunger in a baseplate slot, so that relay 66 is closed. Also, the vertical z-axis safety switch 48 must indicate a raised position such that switch 68 is closed as shown. The timing capsule 70 is now energized such that it can control the singulation press operation. The raising and lowering of the baseplate and circular container holder is controlled by the number two air solenoid 72. The number two air solenoid 72 is controlled by digital counter 56 output via a relay 74 whose contacts 76 close to energize it. The horizontal x–y axis safety switch 44 assumes a lower closed position when its plunger is between baseplate slots while indexing to the next container position and a relay 78 will close until the indexing is completed. An electronic safety check on the non-stamping surfaces of the singulation press punch element monitors lead frame alignment with respect to both the punch element and the lead frame container being loaded. If a lead frame is misaligned with respect to either the punch element or the container, the punch element will not strike the lead frame roll squarely. Such misalignment will cause the cut lead frame to curl around the punch and come in contact with the sides or non-stamping surface(s). The punch electronic safety check sensor 80 will open and inhibit energizing of the operating coil 82 should any non-stamping surface of the punch come in contact with a severed lead frame. This precludes any energizing of the timing capsule 70 which governs press operation.

In summary, the loading device 10 retains multiple lead frame containers and is automatically indexed to the next container position when a container is fully loaded. Thus, the need for human intervention in the lead frame container loading process is minimized. The raising of the baseplate and circular container holder during the loading process eliminates the loss of control previously experienced as stamped lead frames dropped down into the containers. Safety checks monitor lead frame, container and press punch element alignment to inhibit anomalous operation of the singulation press. Thus, the lead frame container loading process ie expedited through the use of the present invention.

To those skilled in the art to which this invention relates, many changes in construction and widely differing embodiments and application of the invention will suggest themselves without departing from the spirit and scope of the invention. The disclosures and descriptions herein are purely illustrative and are not intended to be in any sense limiting.

What is claimed is:

1. An apparatus for use in combination with a lead frame singulation press for loading single lead frames into a container comprising:

a rotary indexing table having a plurality of vertical loader pins spaced apart from each other and at a distance from the center of said indexing table;

a baseplate sitting atop and rotatable with said rotary indexing table held in place by said vertical locator pins;

a circular container holder located above and rotatable with said baseplate means having open-ended compartments extending inward from its perimeter thereby forming spaces sized to accomodate a plurality of containers to be held within the apparatus also held in place by said vertical locator pins;

said circular container holder having a plurality of openings therein to receive said locator pins and thereby connect said container holder and said base-plate for movement together horizontally while allowing vertical displacement of said container holder and said baseplate relative to said rotary indexing table;

means extending upwardly from said base-plate, adapted to exetnd into a container being loaded for guiding the stamped lead frames into the container retained within a said compartment of said circular container holder; and means for indexing said baseplate and circular container holder from one loading position, wherein said compartment and retained container are aligned with said singulation press to the next loading position after the aligned container has been filled.

2. The apparatus of claim 1 including means for retaining each container held within an open-ended compartment of said circular container holder apparatus.

3. The apparatus of claim 2 wherein said retaining means comprises a dowel on said baseplate below said open-ended container compartment and two dowels on opposite sides of each of said open-ended container compartments of said circular container holder fit into each container held within said container holder to ensure retention thereof.

4. The apparatus of claim 2 including means for raising said circular container holder and said baseplate to a loading position and lowering them to an indexing position.

5. The apparatus of claim 4 wherein said means for raising and lowering said circular container holder and said baseplate comprises three air cylinders equally spaced between said locator pin of said rotary indexing table for raising said container holder and said baseplate to a loading position and lowering them to a loading position.

6. The apparatus of claim 4 including means for inhibiting the indexing of said circular container holder and said baseplate to another container position if said container holder and said baseplate are in a raised loading position.

7. The apparatus of claim 6 wherein said means for inhibiting the indexing of said circular container holder and said baseplate comprises a safety switch mounted beneath said baseplate that monitors the vertical z-axis position of said baseplate by means of a plunger which abuts said baseplate when the apparatus is in a lowered position for inhibiting the indexing of said container holder and said baseplate to another container position if said container holder and said baseplate are in a raised loading position.

8. The apparatus of claim 6 including means for inhibiting the raising of said circular container holder and said baseplate to a loading position if said container holder is not properly aligned with the singulation press punch element.

9. The apparatus of claim 8 wherein said means for inhibiting the raising of said circular container holder and said baseplate comprises a safety switch mounted beneath said baseplate, opposite said z-axis safety switch, that monitors the horizontal x–y axis position of said container holder by means of a plunger which fits into slots of said baseplate for inhibiting the raising of said container holder and said baseplate if said container holder is not properly aligned with the singulation press punch element.

10. The apparatus of claim 8 including means for automatically indexing said circular container holder and said baseplate to the next loading position after a container has been filled.

11. The apparatus of claim 10 wherein said means for automatically indexing said circular container holder and said baseplate comprises circuitry which triggers the automatic indexing of said container holder and said baseplate to the next loading position upon a digital counter output of the singulation press.

12. The apparatus of claim 1 including means for inhibiting continued operation of the press if a stamped lead frame is misaligned with respect to either said punch element or the container being loaded by the singulation press.

13. The punch element of claim 12 wherein said means for inhibiting continued operation of the press comprises an internal electronic safety switch that monitors lead frame alignment with respect to both said punch element and the container being loaded by the singulation press for inhibiting continued operation of the press if a stamped lead frame is misaligned with respect to either said punch element or the container.

14. The punch element of claim 12 wherein said punch element has a stamping surface with recesses to accommodate said means for guiding the stamped lead frames into a container retained within said circular container holder.

15. An apparatus for use in combination with a lead frame singulation press for loading single lead frames into a container comprising:

a rotary indexing table having three vertical locator pins equally spaced apart from each other and at the same distance from the center of said indexing table;

a circular baseplate sitting atop and rotatable with said rotary indexing table held in place by said vertical locator pins;

a circular container holder located above and rotatable with said baseplate having open-ended compartments extending inwardly from its perimeter thereby forming spaces sized to accommodate a plurality of containers to be held within said container holder, also held in place by said vertical locator pins;

said circular holder having three openings therein to accommodate said vertical locator pins and thereby connect said container holder and said base-plate for movement together horizontally while allowing vertical displacement of said container holder and said baseplate relative to said rotary indexing table;

said baseplate having slots extending inward from its perimeter corresponding in location to the center of said open-ended compartments of said circular container holder thereby indicating said container holder rotary position relative to said punch element of the singulation press;

guide pins support plates forming a base supporting each container retained within said circular container holder and having two vertical guide pins which extend upward and through the base of a container retained within said containder holder;

a dowel in the center of said guide pins support plates and two dowels on opposite sides of each of said open-ended compartments of said circular container holder which fit into each container held within said container holder to ensure retention thereof; and and air solenoid to control the indexing of said circular container holder and said baseplate to the next loading position after a container has been filled.

* * * * *

UNITED STATES PATENT AND TRADEMARK OFFICE

CERTIFICATE OF CORRECTION

PATENT NO. : 4,656,817

DATED : April 14, 1987

INVENTOR(S) : William McCall Keady, Frank Iseger, Barry Maidment

It is certified that error appears in the above-identified patent and that said Letters Patent are hereby corrected as shown below:

Column 2, line 37, "perimeters" should read --perimeter--
Column 4, line 24, "with" should read --within--
Column 5, line 6, "65" should read --64--
Column 5, line 50, "ie" should read --is--
Column 5, line 61, between "press" and "for", please add --having a punch element and adapted--
Column 5, line 64, "loader" should read --locator--
Column 6, line 15, "exetnd" should read --extend--
Column 6, line 42, "pin" should read --pins--
Column 8, line 8, "inwardly" should read --inward--
Column 8, line 13, between "circular" and "holder", please add --container--
Column 8, line 30, "containder" should read --container--

Signed and Sealed this

Second Day of February, 1988

*Attest:*

*Attesting Officer*

DONALD J. QUIGG

*Commissioner of Patents and Trademarks*